US011198232B2

(12) United States Patent
Furlani

(10) Patent No.: US 11,198,232 B2
(45) Date of Patent: Dec. 14, 2021

(54) APPARATUS AND METHOD FOR PRODUCING FLUID CONCRETE

(71) Applicant: SIMEM S.p.A., Minerbe (IT)

(72) Inventor: Michele Furlani, Angiari (IT)

(73) Assignee: SIMEN S.p.A., Minerbe (IT)

( * ) Notice: Subject to any disclaimer, the term of this patent is extended or adjusted under 35 U.S.C. 154(b) by 189 days.

(21) Appl. No.: 16/605,663

(22) PCT Filed: Apr. 26, 2018

(86) PCT No.: PCT/IB2018/052893
§ 371 (c)(1),
(2) Date: Oct. 16, 2019

(87) PCT Pub. No.: WO2018/198060
PCT Pub. Date: Nov. 1, 2018

(65) Prior Publication Data

US 2020/0171705 A1 Jun. 4, 2020

(30) Foreign Application Priority Data

Apr. 26, 2017 (IT) ..... 102017000045104

(51) Int. Cl.
*B28C 7/04* (2006.01)
*B28C 5/42* (2006.01)
(Continued)

(52) U.S. Cl.
CPC ..... *B28C 7/0486* (2013.01); *B28C 5/422* (2013.01); *B28C 5/4231* (2013.01);
(Continued)

(58) Field of Classification Search
CPC ..... B28C 7/0486; B28C 5/422; B28C 5/4231; B28C 5/4237; B28C 5/4272;
(Continued)

(56) References Cited

U.S. PATENT DOCUMENTS 4,403,863 A 9/1983 Fukushima et al.
4,789,244 A * 12/1988 Dunton ..... B01F 3/04992 366/101
(Continued)

FOREIGN PATENT DOCUMENTS

FR 2969505 A1 6/2012
WO 2016/196599 A1 * 12/2016

OTHER PUBLICATIONS

International Search Report issued for PCT/IB2018/052893, dated Aug. 6, 2018 (3 pages).

*Primary Examiner* — Charles Cooley
(74) *Attorney, Agent, or Firm* — Arent Fox LLP

(57) ABSTRACT

An apparatus and method for producing fluid concrete include a first mixer configured to mix at least water and cement so as to make a low fluidity concrete having consistency class ≤S2, a truck mixer that can be configured to mix the low fluidity concrete with further water so as to make a fluid concrete having consistency class ≥S2, and a water supply and at least a cement supply configured so that the apparatus or method can produce fluid concrete. The apparatus and method include a control and adjustment unit, connected to the water supply and at least to the cement supply, configured to selectively control and adjust the introduction of water and cement into the first mixer and the introduction of further water into the cement mixer.

14 Claims, 4 Drawing Sheets

(51) Int. Cl.
*B28C 7/02* (2006.01)
*B28C 7/12* (2006.01)
*B28C 7/16* (2006.01)

(52) U.S. Cl.
CPC ..... *B28C 5/4237* (2013.01); *B28C 5/4272* (2013.01); *B28C 5/4286* (2013.01); *B28C 7/024* (2013.01); *B28C 7/0418* (2013.01); *B28C 7/0481* (2013.01); *B28C 7/126* (2013.01); *B28C 7/162* (2013.01)

(58) Field of Classification Search
CPC ..... B28C 5/4286; B28C 7/024; B28C 7/0418; B28C 7/0481; B28C 7/126; B28C 7/162; B28C 7/12
See application file for complete search history.

(56) References Cited

U.S. PATENT DOCUMENTS 4,795,263 A 1/1989 Kaga
5,713,663 A * 2/1998 Zandberg ..... B28C 7/0454 366/8
6,042,258 A * 3/2000 Hines ..... B28C 7/024 366/8
6,042,259 A * 3/2000 Hines ..... B28C 7/024 366/17
7,972,436 B2 * 7/2011 Ou ..... C04B 40/0039 106/726
8,020,431 B2 * 9/2011 Cooley ..... B28C 5/422 366/1
8,118,473 B2 * 2/2012 Compton et al. ..... B28C 5/422 366/17
8,727,604 B2 * 5/2014 Compton ..... B28C 5/422 366/142
8,746,954 B2 * 6/2014 Cooley ..... B28C 5/422 366/143
8,818,561 B2 * 8/2014 Koehler ..... G01N 11/00 700/265
8,960,990 B2 * 2/2015 Koehler ..... B28C 7/026 366/61
8,989,905 B2 * 3/2015 Sostaric ..... B01F 15/00207 700/265
9,789,628 B2 * 10/2017 Chun ..... B28C 7/022
9,789,629 B2 * 10/2017 Koehler ..... G05D 21/02
10,329,202 B2 * 6/2019 Tregger ..... C04B 40/0032
10,363,684 B2 * 7/2019 Roberts ..... G01N 11/00
2007/0185636 A1 * 8/2007 Cooley ..... B28C 7/12 701/50
2008/0273415 A1 * 11/2008 Thornton et al. ..... B28C 7/0418 366/3
2008/0316856 A1 * 12/2008 Cooley ..... B28C 5/4275 366/142
2009/0037026 A1 * 2/2009 Sostaric ..... B01F 15/00207 700/265
2011/0029134 A1 * 2/2011 Hazrati ..... B28C 7/026 700/265
2011/0077778 A1 * 3/2011 Berman ..... G05B 15/02 700/265
2011/0088599 A1 * 4/2011 Koyata ..... C04B 40/0039 106/803
2011/0320040 A1 * 12/2011 Koehler ..... C04B 40/0032 700/265
2012/0016523 A1 * 1/2012 Koehler ..... G01N 11/00 700/265
2014/0107844 A1 * 4/2014 Koehler ..... G05D 21/02 700/265
2016/0355441 A1 * 12/2016 Tregger ..... B28C 7/024
2017/0087743 A1 * 3/2017 Roberts ..... F24F 3/0442
2019/0256428 A1 * 8/2019 Tregger ..... C04B 40/0032
2021/0291403 A1 * 9/2021 Goldstein ..... B28C 5/422

* cited by examiner

APPARATUS AND METHOD FOR PRODUCING FLUID CONCRETE

CROSS-REFERENCE TO RELATED APPLICATIONS

This application is the U.S. National Stage Application of International Patent Application No. PCT/IB2018/052893, filed on Apr. 26, 2018, which claims priority to Italian Patent Application No. 102017000045104, filed on Apr. 26, 2017, the contents of each of which is incorporated herein by reference in its entirety.

TECHNICAL FIELD

The present invention has as its subject an apparatus and a method for producing fluid concrete continuously or in batches. Preferably, the present invention is applied to systems for the continuous production of fluid concrete.

The present invention finds particular application in the sector of building and construction.

PRIOR ART

Concrete is an artificial mix that can be made by mixing water, cement, aggregates and any additives.

The workability of the fresh concrete, referred to as the "consistency" in legislation in force, is an index of the properties and the behaviour of the concrete in the interval of time between the production and the compacting of the mix in situ in the mould.

As is well known in the building sector (see for example standards UNI EN 206-2006 and UNI 11104:2004), the workability of concrete is measured through the Abrams cone test, classifying it with a variable degree of slump between S1 and S5. The slump identifies the slump value of the concrete and according to the measured value it is possible to determine which consistency class the concrete belongs to.

The consistency classes through the slump of the Abrams cone are as follows:

S1 (dry consistency): slump from 10 to 40 mm;

S2 (standard consistency): slump from 50 to 90 mm;

S3 (wet consistency): slump from 100 to 150 mm;

S4 (very wet consistency): slump from 160 to 210 mm;

S5 (self-levelling consistency): slump 220 mm.

Therefore, an S5 type concrete will be more fluid than an S1 type concrete.

Nowadays the production of concrete can take place continuously or in batches according to the type of concrete to be made.

In the event of continuous production, a cylindrical mixer is typically used, provided with blades rotating about a shaft and supplied continuously with the materials needed for making the concrete. The motion of the blades makes the mix advance along an advancement direction parallel to the axis of rotation of the shaft, making the mix reach the end of the mixer in which there is an opening from where the mixed concrete exits.

This type of production is used to produce cement and concrete mixes with low slump (S1 or S2), as with an unloading section that is always open, the presence of too much water would make the concrete slip out of the mixer before being correctly mixed; therefore, it is not advisable for use in the production of S3, S4 and S5 concrete.

In the event of batch production with a mixer or cement mixer, the concrete is typically produced in different steps.

The first step envisages the dosing of the materials to be mixed in the mixer or cement mixer according to a defined recipe.

The second step envisages the mixing of the materials for a sufficient amount of time to obtain good uniformity of the concrete.

Unlike the continuous system, in the batch system, the mixing chamber is provided with a door that is opened when the mix is completed.

The third step envisages the opening of the unloading door of the mixer and the concrete made is unloaded, which is conveyed into: cement mixers, movable buckets or other systems for its transport in situ.

With the batch production system, all types of concrete can be produced, as there is forced mixing, in which it is possible to decide how long the product is to be mixed for, and the degree of slump of the material no longer has an influence.

The most common batch systems for producing fluid concrete sold on the market can be split into two types:

- systems for producing concrete with a so-called "dry-plant", in which the materials are dosed and conveyed into truck mixers, which perform the mixing; this system has the advantage of being cheap in terms of plant costs, but does not guarantee good quality mixing and generates dust during loading, therefore it requires appropriate abatement systems;
- production systems with a pre-mixed plant (so-called "wet-plants"): the materials are introduced into a forced mixer (double axis or planetary) which unloads by gravity into the cement mixer; this is the most common system and guarantees good quality mixing, but to have high hourly production levels, large mixers are required, with substantial plant costs and electrical consumptions.

Therefore, when using continuous systems, it is not possible to make fluid concretes, whereas when using batch systems, it is not possible to guarantee high productivity because of the large dimensions that would be necessary for producing large quantities of concrete and the processing costs and times.

AIMS OF THE INVENTION

In this context, the technical task that is the basis of the present invention is to disclose an apparatus and a method for producing fluid concrete that obviate one or more of the drawbacks of the above-cited prior art.

In particular, it is an object of the present invention to provide an apparatus for producing fluid concrete with contained dimensions that allows more or less fluid concretes to be produced with any slump value.

A further object of the present invention is to propose a method for producing fluid concrete that allows the efficiency of the production process to be improved.

The stated technical task and specified objects are substantially achieved by an apparatus and a method for producing fluid concrete, comprising the technical features disclosed in one or more of the appended claims.

In particular, the present invention envisages an apparatus for continuously producing fluid concrete, comprising:

- a first mixer configured to mix at least a first quantity of water and cement so as to make a low fluidity concrete having consistency class ≤S2, wherein the first mixer has an outlet section arranged at an ejection height with respect to a horizontal reference plane and adapted to expel the low fluidity concrete, a second mixer (truck mixer) having a loading section configured and arranged so as to receive the low fluidity concrete coming from the first mixer, wherein the second mixer is configured to mix the low fluidity concrete with a second quantity of water (or further water) so as to make a fluid concrete having consistency class ≥S2, a water supply means configured to supply water to the first mixer and further water to the second mixer and at least one cement supply means configured to supply cement to the first mixer so that the apparatus can produce fluid concrete, a control and adjustment unit, connected to the water supply means and at least to the cement supply means, configured to selectively control and adjust the introduction of water and cement into the first mixer and the introduction of further water into the second mixer.

The dependent claims herein incorporated for reference, correspond to different embodiments of the invention.

BRIEF DESCRIPTION OF THE FIGURES

Further characteristics and advantages of the present invention will become clearer from the indicative, and therefore non-limiting, description of a preferred but not exclusive embodiment of an apparatus for producing fluid concrete, as illustrated in the attached drawings, in which.

DETAILED DESCRIPTION OF ONE OR MORE PREFERRED EMBODIMENTS OF THE INVENTION

With reference to the appended figures, 1 indicates as a whole an apparatus for producing fluid concrete according to the present invention, hereinafter simply apparatus 1.

The apparatus 1 comprises a first mixer 100 configured to mix at least water A1 and cement C inside it so as to make a low fluidity concrete 2, having consistency class ≤S2.

Through an outlet section 105, arranged at an ejection height h1 with respect to a horizontal reference plane H, the mixed low fluidity concrete 2 is ejected from the first mixer 100.

Figure 1:
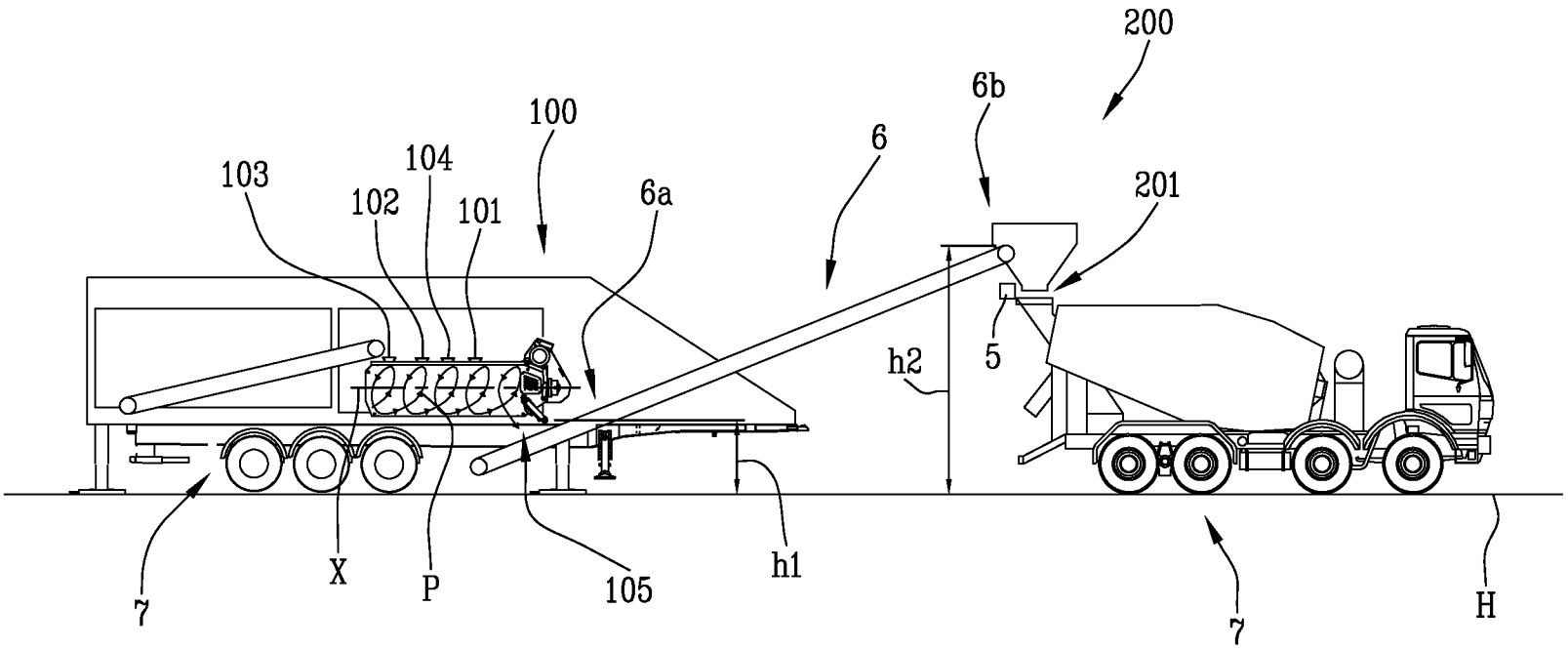
FIG. 1 is a partially sectioned schematic lateral view of a first embodiment of an apparatus for producing fluid concrete according to the present invention.
Figure 2:
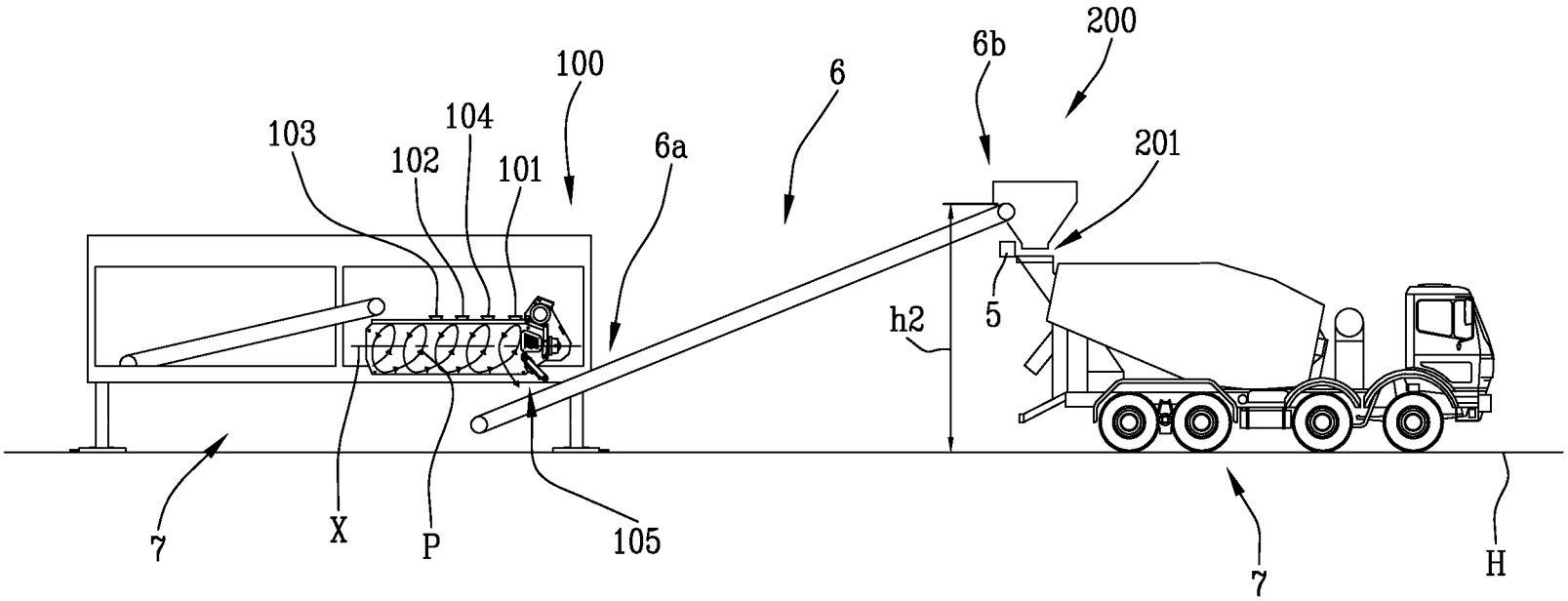
FIG. 2 is a partially sectioned schematic lateral view of a second embodiment of an apparatus for producing fluid concrete according to the present invention.
Figure 3:
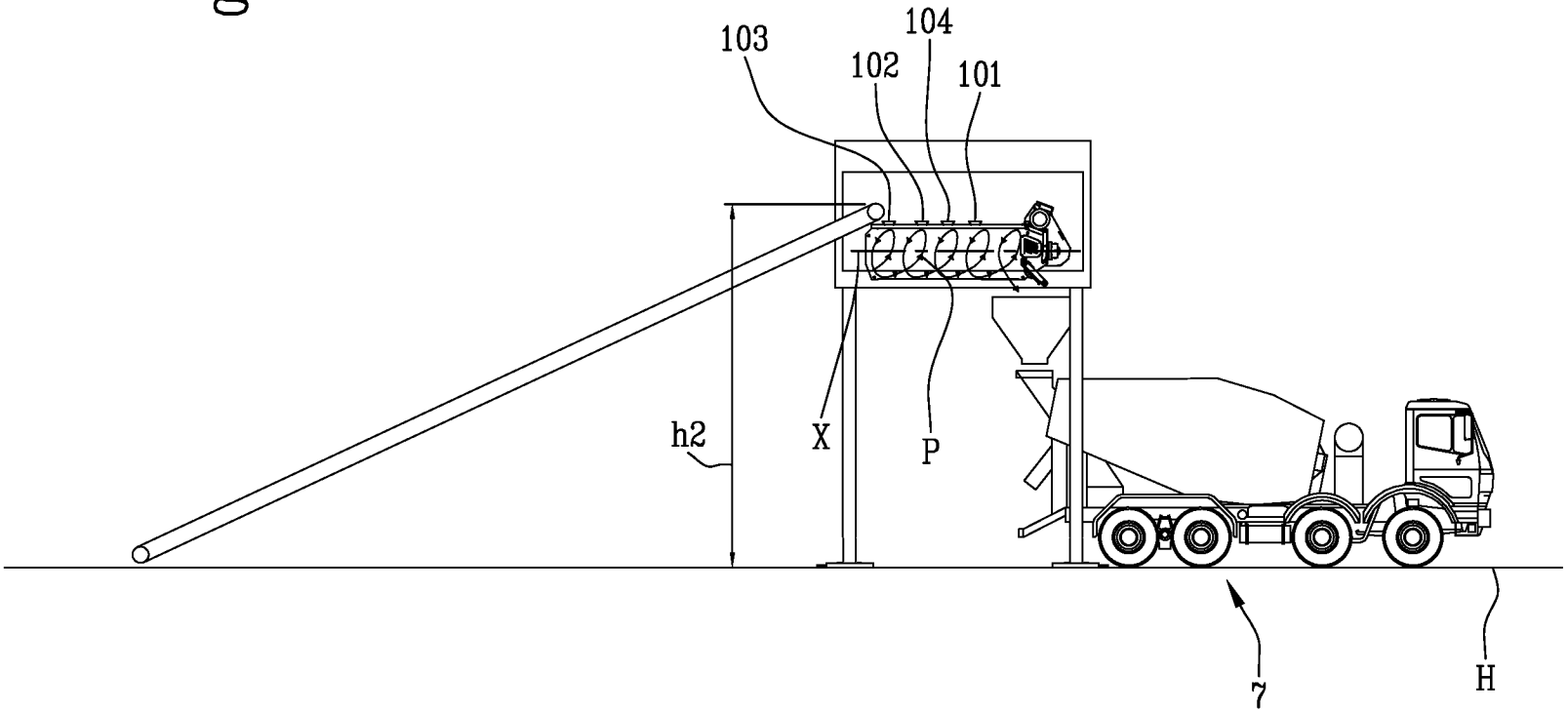
FIG. 3 is a partially sectioned schematic lateral view of a third embodiment of an apparatus for producing fluid concrete according to the present invention.
Figure 4:
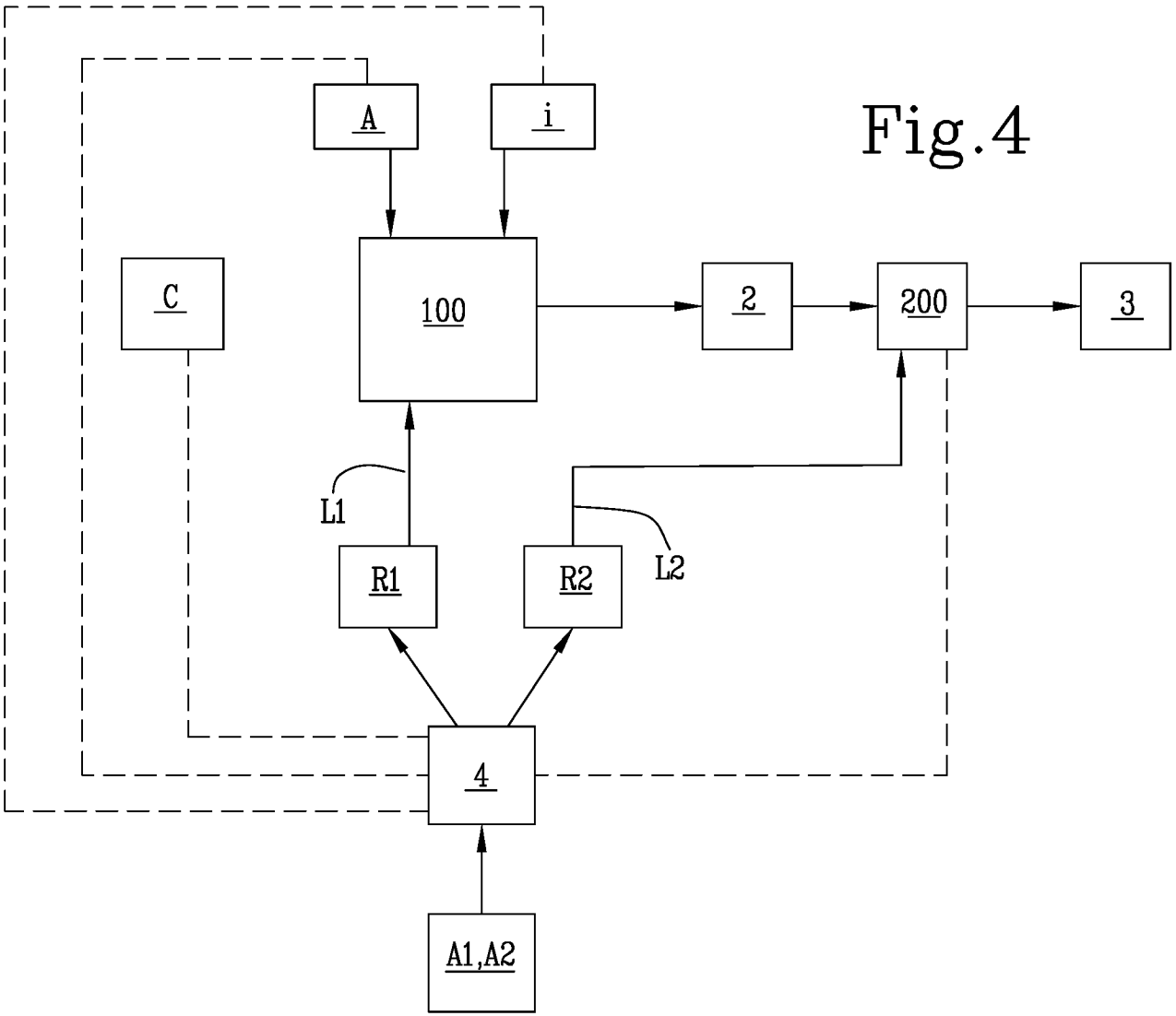
FIG. 4 is an operating diagram of the apparatus for producing fluid concrete in accordance with the present invention.

With reference to the embodiments illustrated in FIGS. 1-3, preferably the first mixer 100 comprises a first inlet section 101 for supplying the water A1, a second inlet section 102 for supplying cement C, and even more preferably a third inlet section 103 for supplying additives B and/or a fourth inlet section 104 for supplying aggregates I.

Preferably the first mixer 100 comprises a stirrer, not illustrated in the appended figures, with blades rotating about an axis of rotation X substantially parallel to the horizontal reference plane H configured to mix at least the water A1 and the cement C supplied to the first mixer 100 and to make the low fluidity concrete 2 obtained by mixing advance towards the outlet section 105, as illustrated for example schematically by the path P in FIGS. 1-3.

The apparatus 1 advantageously further comprises a second mixer 200 having a loading section 201 configured and arranged to receive the low fluidity concrete 2 coming from the first mixer 100 to mix it with further water A2 so as to make a fluid concrete 3 having consistency class ≥S2.

Thanks to the presence of the second mixer 200 it is therefore possible to make a fluid concrete 3 having a higher consistency class S than that of the low fluidity concrete 2 made in the first mixer 100, simply by adding, according to doses predefined by corresponding recipes, further water A2 to the low fluidity concrete 2 coming from the first mixer 100.

Advantageously, by further supplying the second mixer 200, for example a truck mixer adapted to transport the concrete in situ as illustrated in FIGS. 1-3, with low fluidity concrete 2 rather than with powdered cement C it is possible to prevent the dispersion of dust and reduce the mixing times, since the low fluidity concrete 2 is already pre-mixed by the first mixer 100. The apparatus 1 according to the present invention further comprises a water supply means, not illustrated, configured to supply water A1 to the first mixer 100 and further water A2 to the second mixer 200 and at least one cement supply means configured to supply cement C to the first mixer 100 so that the apparatus 1 can produce fluid concrete 3.

The apparatus 1 then comprises a control and adjustment unit 4, connected to the water supply means and to the cement supply means.

The control and adjustment unit 4 is configured to selectively control and adjust the introduction of water A1 and cement C into the first mixer 100 and the introduction of further water A2 into the second mixer 200. Therefore, the mixing process is advantageously automated and able to independently manage the quantity of water A1, further water A2 and at least cement C to be mixed in the respective mixers 100, 200 to continuously produce first low fluidity concrete 2 and then fluid concrete 3. Advantageously, thanks to the present invention, the apparatus 1 can produce any type of concrete simply by selectively controlling the introduction of further water A2 in the second mixer 200.

If, for example, class S1 concrete is to be produced, it is possible to mix at least water A1 and cement C in the first mixer 100 and to eject the low fluidity concrete 2 from the first mixer 100 for immediate use/transport; if, instead, class S5 concrete is to be produced, it is possible to send, for example, by transporting it at height through a conveyor belt 6 (as will be clearer in the following description), the low fluidity concrete 2 produced in the first mixer 100 to the second mixer 200 which will perform further mixing with further water A2 and make the fluid concrete 3 required.

Preferably, the water supply means comprises a first supply line L1 for supplying water A1 connected to the first inlet section 101 of the first mixer 100 and a second supply line L2 of further water A2 connected to the loading section 201 of the second mixer 200, wherein the supply lines L1, L2 comprise respective pumps, not illustrated, connected to the control and adjustment unit 4.

Preferably, the second mixer 200 comprises a detection device 5 for detecting identification parameters of the low fluidity concrete 2, e.g. a moisture sensor, arranged at the loading section 201 of the second mixer 200 itself and connected with the control and adjustment unit 4 to detect the identification parameters of the low fluidity concrete 2 at the inlet to the loading section 201 and to transmit them to the control and adjustment unit 4.

For example, the identification parameters may be: pressure, moisture, flow rate, density.

Advantageously, the control and adjustment unit 4 is in fact configured to compare the identification parameters with standard reference parameters of the low fluidity concrete 2 so as to adjust the amount of further water A2 to be introduced into the second mixer 200.

Thanks to the presence of the detection device 5 it is possible to constantly monitor the quality of the low fluidity concrete 2 and precisely monitor the dosage of further water A2 for making the fluid concrete 3 to be obtained.

As illustrated in the embodiments of FIGS. 1 and 2, preferably according to the present invention, the apparatus 1 comprises a conveyor belt 6 having a loading zone 6*a* arranged at the outlet section 105 of the first mixer 100 and an unloading zone 6*b*, opposite the loading zone 6*a*, arranged at a higher unloading height h2 than the ejection height h1 at the loading section 201 of the second mixer 200.

The loading zone 6*a* is adapted to receive the low fluidity concrete 2, so that the conveyor belt 6 can transport the low fluidity concrete 2 from the loading zone 6*a* to the unloading zone 6*b* at which the low fluidity concrete 2 can fall by gravity.

Advantageously, in this way it is possible to transport at height the low fluidity concrete 2 produced by the first mixer 100 without risks of disgregation or separation of the water A1 and mix it in the second mixer 200 with further water A2 to obtain the fluid concrete 3 of any consistency class greater than S2.

Typically, in work sites, concrete is transported by means of the movement of the second mixer 200 in the form of a truck mixer. The latter typically has a loading section 201 arranged in the upper part of the rear axle of the vehicle, therefore the filling of the truck mixer itself with a fluid concrete having consistency class greater than S2, without providing expensive and bulky apparatus for producing concrete of the fixed type with ejection heights h1 of the concrete higher than the unloading height h2 of the truck mixer, is often problematic if not impossible.

In fact, as already mentioned previously, the transport of the fluid concrete at height could risk compromising its integrity. However, thanks to the present invention it is possible to realise the mixing of water A1 and cement C at a lower ejection height h1 with respect to the ground (substantially simplifying the site logistics) in the first mixer 100 to obtain a low fluidity concrete 2 and then transport it efficiently without any risks to the loading section 201 of the truck mixer for the possible addition of further water A2 in order to obtain any type of fluid concrete 3.

Therefore, the apparatus 1 can advantageously comprise a movement means 7 configured to move the first mixer 100 (see FIG. 1) and/or the second mixer 200 (see FIGS. 1-3).

In the embodiment of FIG. 1, for example, the apparatus 1 comprises a first mixer 100 movable on wheels for being easily transported by road, particularly useful for temporary or short-term sites, while in FIGS. 2 and 3 the first mixer 100 is of the fixed type.

According to a further aspect of the present invention a method is provided for producing fluid concrete 2 comprising the steps of:

supplying at least water A1 and cement C to the first mixer 100 (it is also possible to supply additives B and/or aggregates I based on the requested mix-design), mixing at least the water A1 and the cement C inside the first mixer 100 for making the low fluidity concrete 2, ejecting the low fluidity concrete 2 from the first mixer 100 at the ejection height h1, preferably transporting the low fluidity concrete 2 from the ejection height h1 to the unloading height h2, supplying the low fluidity concrete 2 to the second mixer 200, mixing the low fluidity concrete 2 with further water A2 supplied into the second mixer 200 so as to make the fluid concrete 3, selectively controlling and adjusting the introduction of water A1 and cement C into the first mixer 100 and the introduction of further water A2 into the second mixer 200.

Preferably, the method comprises the step of detecting the identification parameters of the low fluidity concrete 2 during the step of supplying the low fluidity concrete 2 to the second mixer 200, and a subsequent step of comparing the identification parameters with the standard reference parameters so as to control and adjust the amount of further water A2 to be introduced into the second mixer 200.

Preferably the control and adjustment unit 4 is also able to control and adjust the supply of aggregates I and additives B if present.

Therefore, the method just described advantageously allows concrete to be obtained having any consistency class between S1 and S5 very quickly, safely and efficiently.

The present invention therefore reaches the objects proposed, overcoming the drawbacks described in the prior art and providing an apparatus and a method that allow more or less fluid concretes to be produced with any slump level and not only in batches.

Thanks to the operation it is also possible to guarantee higher hourly production rates with respect to batch production with the same capacity of the first mixer 100, and to obtain greater productivity of the apparatus 1 with contained component sizes and reduced electrical consumptions.

Advantageously, an initial mixture of concrete is produced with low fluidity (low fluidity concrete 2) having maximum slump S2, by inserting a minimum amount of water A1 into the first mixer 100, to make sure the cement C that is activated by the water A1 works and binds correctly forming an optimal mixture and making sure that the density of the material does not allow any overflow from the outlet section 105 of the first mixer 100, and allows the low fluidity concrete 2 to be transported through a conveyor belt 6 if the latter is provided.

If the required concrete has slump greater than S2, the further water A2 is added in the loading section 201 and the mixing is completed in the second mixer 200 (e.g. truck mixer or cement mixer), thus obtaining a fluid and uniform concrete 3 with the desired slump.

The present invention further advantageously allows apparatuses 1 of the mobile type and with contained dimensions to be realised.

The invention claimed is:

1. An apparatus for producing fluid concrete comprising:

at least a first mixer (100) configured to mix at least cement (C) with at least a first amount of water (A1) sufficient to realize a low fluidity concrete (2) having consistency class ≤S2, said first mixer (100) having an outlet section (105) adapted to expel said low fluidity concrete (2), a water supply means configured to supply said first amount of water (A1) to said first mixer (100);

a cement supply means configured to supply cement (C) to said first mixer (100);

a control and adjustment unit (4), connected to said water supply means and to said cement supply means, configured to calculate said first amount of water (A1) and to selectively control and adjust an introduction of said first amount of water (A1) and cement (C) into the first mixer (100);

wherein said water supply means is configured to supply a second amount of water (A2) at or downstream of the outlet section (105) of the first mixer (100);

said control and adjustment unit (4) being configured to calculate said second amount of water (A2) to make a fluid concrete (3) having consistency class ≥S2, and to control and adjust the supply of said second amount of water (A2) at or downstream of said outlet section (105);

said control and adjustment unit (4) being configured to pre-calculate said first amount of water (A1) and said second amount of water (A2) according to a type of concrete to be made prior to the introduction of said first amount of water (A1) and cement (C) into the first mixer (100); and a second mixer (200) having a loading section (201) arranged to receive said low fluidity concrete (2) coming from the first mixer (100), said second mixer (200) being configured to mix the low fluidity concrete (2) with said second amount of water (A2) to make the fluid concrete (3) having consistency class ≥S2.

2. The apparatus according to claim 1, wherein said control and adjustment unit (4) is further configured to pre-calculate an amount of cement (C) and/or aggregates (i) and/or additives (B) according to the type of concrete to be made prior to the introduction of said first amount of water (A1) and cement (C) into the first mixer (100).

3. The apparatus according to claim 1, further comprising a detection device (5) for detecting one or more identification parameters identifying the low fluidity concrete (2), arranged at or downstream of the outlet section (105) and connected with said control and adjustment unit (4) for detecting said identification parameters of the low fluidity concrete (2) and for transmitting them to the control and adjustment unit (4); and said control and adjustment unit (4) being configured to compare said identification parameters with one or more standard reference parameters of the low fluidity concrete (2) so as to adjust said second amount of water (A2) to be introduced at or downstream of the outlet section (105).

4. The apparatus according to claim 1, wherein said water supply means comprises a first supply line (L1) for supplying said first amount of water (A1) connected to a first inlet section (101) of the first mixer (100) and a second supply line (L2) for supplying said second amount of water (A2) connected downstream of the outlet section (105), said first and second supply lines (L1, L2) comprising respective pumps connected to said control and adjustment unit (4).

5. The apparatus according to claim 1, wherein said first mixer (100) comprises a second inlet section (102) for supplying the cement (C), and at least a third inlet section (103) for supplying additives (B) and/or a fourth inlet section (104) for supplying aggregates (I).

6. The apparatus according to claim 1, wherein said first mixer (100) comprises a stirrer with blades rotating about an axis of rotation (X) substantially parallel to a horizontal reference plane (H) configured to mix at least said first amount of water (A1) and said cement (C) and to make the low fluidity concrete (2) obtained from mixing advance towards said outlet section (105).

7. The apparatus according to claim 1, comprising a conveyor belt (6) having a loading zone (6*a*) arranged at the outlet section (105) of the first mixer (100) to receive said low fluidity concrete (2), and configured to transport said low fluidity concrete (2) from the loading zone (6*a*) to a discharge zone (6*b*) of the conveyor belt (6) itself opposite the loading zone (6*a*); and said water supply means being configured to supply the second amount of water (A2) at said discharge zone (6*b*).

8. The apparatus according to claim 7, wherein said discharge zone (6*b*) is arranged at a discharge height (h2) at which said low fluidity concrete (2) can fall by gravity, wherein said discharge height (h2) is greater than an ejection height (h1) of the outlet section (105) with respect to a horizontal reference plane (H).

9. The apparatus according to claim 7, wherein said discharge zone (6*b*) is arranged at a discharge height (h2) that is less than or equal to an ejection height (h1) of the outlet section (105) with reference to a horizontal plane (H).

10. The apparatus according to claim 9, wherein said first mixer (100) is arranged at said discharge height (h1).

11. The apparatus according to claim 1, further comprising a detection device (5) for detecting one or more identification parameters of the low fluidity concrete arranged at the loading section (201) downstream of the second mixer (200) itself and connected with the control and adjustment unit (4) to detect the identification parameters of the low fluidity concrete (2) at an inlet to the loading section (201) and to transmit them to the control and adjustment unit (4).

12. The apparatus according to claim 11, wherein the second mixer (200) is part of a truck mixer.

13. A method for producing fluid concrete, the method comprising:

supplying at least a first amount of water (A1) and cement (C) to a first mixer (100), mixing at least said first amount of water (A1) and said cement (C) into said first mixer (100) for making a low fluidity concrete (2) having slump class ≤S2, ejecting the low fluidity concrete (2) from said first mixer (100) at an outlet section (105), mixing said ejected low fluidity concrete (2) with a second amount of water (A2) at or downstream of said outlet section (105) to make a fluid concrete (3) having slump class ≥S2, said second amount of water (A2) being supplied to said outlet section (105);

selectively controlling and adjusting an introduction of said first amount of water (A1) and cement (C) into the first mixer (100) and supplying said second amount of water (A2);

said first amount of water (A1) and said second amount of water (A2) being pre-calculated according to a type of concrete to be made prior to mixing said first amount of water (A1) and cement (C) in the first mixer (100); and mixing the low fluidity concrete (2) with said second amount of water (A2) at a second mixer (200) configured to make a fluid concrete (3) having slump class ≥S2.

14. The method according to claim 13, further comprising detecting (5) one or more identification parameters of the concrete downstream of the second mixer (200) to detect the identification parameters of the concrete (2) at an inlet to a loading section (201) arranged downstream of the second mixer (200) and to adjust said first amount of water (A1) and said second amount of water (A2).

* * * * *